US006711270B2

(12) United States Patent
Masuda

(10) Patent No.: US 6,711,270 B2
(45) Date of Patent: Mar. 23, 2004

(54) AUDIO REPRODUCING APPARATUS

(75) Inventor: Hiroshi Masuda, Tokyo (JP)

(73) Assignee: Sony Corporation, Tokyo (JP)

( * ) Notice: Subject to any disclaimer, the term of this patent is extended or adjusted under 35 U.S.C. 154(b) by 560 days.

(21) Appl. No.: 09/728,460

(22) Filed: Dec. 1, 2000

(65) Prior Publication Data

US 2001/0014159 A1 Aug. 16, 2001

(30) Foreign Application Priority Data

Dec. 2, 1998 (JP) ..... P11-342708

(51) Int. Cl.[7] ..... H04R 5/02
(52) U.S. Cl. ..... 381/309; 381/307; 381/22
(58) Field of Search ..... 381/1, 17, 18, 381/19, 307, 309, 310, 26, 119, 22, 23

(56) References Cited

U.S. PATENT DOCUMENTS 5,768,394 A * 6/1998 Heo ..... 381/18
6,009,179 A * 12/1999 Wood et al. ..... 381/17
6,067,361 A * 5/2000 Kohut et al. ..... 381/17
6,122,381 A * 9/2000 Winterer ..... 381/17
6,332,026 B1 * 12/2001 Kuusama et al. ..... 381/17

* cited by examiner

*Primary Examiner*—Xu Mei
(74) *Attorney, Agent, or Firm*—Jay H. Maioli

(57) ABSTRACT

The invention relates to an audio reproducing apparatus having a converting means for converting main audio signals included in an audio signal for a plurality of channels into audio signals that provide a reproduction sound field similar to that obtained in reproduction by means of speakers even when the audio signals are reproduced by means of headphones; and an adding means for adding an auxiliary audio signal included in the audio signal for a plurality of channels to an audio signal outputted from the converting means; wherein an audio signal outputted from the adding means is supplied to headphones.

9 Claims, 6 Drawing Sheets

AUDIO REPRODUCING APPARATUS

BACKGROUND OF THE INVENTION

The present invention relates to an audio reproducing apparatus for reproducing a single-channel or a multichannel audio signal by means of headphones.

As a multichannel audio signal, there is known a 5.1-channel digital audio signal employed in the AC-3 (so-called Dolby digital) system. The 5.1-channel digital audio signal S5.1 is generated by encoding the following signals into a piece of serial data.

SLF: audio signal for a channel at the left front of the listener

SRF: audio signal for a channel at the right front of the listener

SCF: audio signal for a channel at the center front of the listener

SLB: audio signal for a channel at the left back (or on the left side) of the listener SRB: audio signal for a channel at the right back (or on the right side) of the listener SLFE: audio signal representing a component in a low frequency range below 120 Hz, for example.

The digital audio signal S5.1 recorded on, for example, a DVD together with a video signal provides effects such that when the image of the video signal is reproduced, the position of a sound source in the image coincides with that of a sound image that is actually heard, and also a naturally spreading sound field is created.

The digital audio signal S5.1 is basically intended for reproduction by means of speakers that are disposed around the listener. However, there has been contrived an audio reproducing apparatus that makes it possible to reproduce a similar reproduction sound field by means of headphones.

Specifically, in FIG. 3, reference numeral 200 denotes an example of such an audio reproducing apparatus. Reference numeral 100 denotes a DVD player.

Now, a 5.1-channel digital audio signal S5.1 is extracted from the DVD player 100. The audio signal S5.1 is supplied to a decoder circuit 10 of the audio reproducing apparatus 200, where digital audio signals SLF to SLFE for respective channels are decoded. Then, the decoded and extracted audio signals SLF and SRF are supplied via adding circuits 21 and 22 to a converting circuit 3F, which will be described below, while the audio signals SLB and SRB are supplied via adding circuits 23 and 24 to a converting circuit 3B.

Furthermore, the audio signal SCF is basically a signal to be supplied to a speaker disposed at the center front of the listener; however, a similar effect can be obtained even when the signal SCF is supplied to speakers disposed respectively at the left front and at the right front of the listener. Therefore, the signal SCF is supplied to the adding circuits 21 and 22 to be added to the audio signals SLF and SRF. In addition, the audio signal SLFE is a signal representing a low frequency range below 120 Hz, and its reproduced sound does not provide a directional feeling. Thus, the audio signal SLFE is supplied to the adding circuits 21 to 24 to be added to each of the signals SLF to SRB. Signals SLF0 to SRB0 are extracted from the adding circuits 21 to 24.

The converting circuit 3F is provided to convert audio signals SLF0 and SRF0 into audio signals that can provide a reproduction sound field similar to that obtained in speaker reproduction even when the audio signals SLF0 and SRF0 are to be reproduced by means of headphones. Signal processing by the converting circuit 3F will hereinafter be referred to as virtual sound image localization processing.

Specifically, the converting circuit 3F processes the original audio signals SLF0 and SRF0 in such a way that when output audio signals SLFX and SRFX of the converting circuit 3F are supplied to the headphones, a reproduction sound field similar to that obtained when the audio signals SLF0 and SRF0 before the conversion are supplied to speakers disposed respectively at the left front and at the right front of the listener can be obtained.

Similarly, the converting circuit 3B processes the original audio signals SLB0 and SRB0 in such a way that when output audio signals SLBX and SRBX of the converting circuit 3B are supplied to the headphones, a reproduction sound field similar to that obtained when the audio signals SLB0 and SRB0 before the conversion are supplied to speakers disposed respectively at the left back and at the right back of the listener can be obtained. Incidentally, specific configurations of the converting circuits 3F and 3B will be described later.

Then, an audio signal SLFX from the converting circuit 3F and an audio signal SLBX from the converting circuit 3B are added together at an adding circuit 4L to be converted into a digital audio signal SL for a left channel. Also, an audio signal SRFX from the converting circuit 3F and an audio signal SRBX from the converting circuit 3B are added together at an adding circuit 4R to be converted into a digital audio signal SR for a right channel.

Then, these audio signals SL and SR are supplied to D/A converter circuits 5L and 5R, where the audio signals SL and SR are subjected to D/A conversion to become analog audio signals SL and SR. The resulting audio signals SL and SR are supplied via amplifiers 6L and 6R to acoustic units (electroacoustic transducer devices) 7L and 7R of the headphones 7 for a left and a right channel.

FIG. 4 shows a specific example of the converting circuit 3F. The converting circuit 3F is provided to realize virtual sound image localization processing for the audio signals SLF0 and SRF0 by convolving respective transfer functions for ranges from speakers at the left front and at the right front of the listener to both ears of the listener in the audio signals SLF0 and SRF0 using digital filters or by signal processing substantially similar to the above method.

Specifically, the audio signals SLF0 and SRF0 from the adding circuits 21 and 22 are supplied to an adding circuit 31L and a subtracting circuit 31R to form a sum signal and a difference signal. The sum signal and the difference signal are supplied to digital filters 32L and 32R, respectively.

The digital filters 32L and 32R are each provided with a delay circuit 321 having a plurality of stages connected in a cascade manner, a plurality of coefficient circuits 322 and adding circuits 323. The digital filters 32L and 32R are of a FIR type. An input signal is supplied to a first stage of the delay circuit 321 to be sequentially delayed, and an output signal from each stage of the delay circuit 321 is supplied to a coefficient circuit 322 to be multiplied by a specified coefficient. The signals resulting from the multiplication are added to each other by an adding circuit 323, and the result is extracted as a filter output.

Then, output signals from the digital filters 32L and 32R are supplied to a subtracting circuit 33L and an adding circuit 33R to form a difference signal and a sum signal. The difference signal and the sum signal are extracted as output signals SLFX and SRFX of the converting circuit 3F.

Here, respective head related transfer functions for ranges from speakers at the left front and at the right front of the listener to both ears of the listener are convolved in the audio signals SLF0 and SRF0 by providing specified characteristics to the digital filters 32L and 32R. Incidentally, the converting circuit 3B can be configured in the same manner as the converting circuit 3F, and therefore description of the converting circuit 3B will be omitted.

As described above, according to the audio reproducing apparatus 200 of FIG. 3, a reproduction sound field similar to that obtained by means of five speakers disposed at the left front, at the center front, at the right front, in the left rear, and in the right rear of the listener and a speaker for a low frequency range can be reproduced by means of the headphones 7.

However, it has been found that in the case of the audio reproducing apparatus 200 of FIG. 3, reproduced sound outputted from the headphones 7 lacks low frequency sound that should be obtained from the audio signal SLFE representing a component in a low frequency range. According to a consideration given by the inventor of the present invention, it has also been found that the low frequency sound is lacking for the following reasons.

Now, as shown in FIG. 5, if a speaker SP30 is disposed at a position 30° to the right of the front of a dummy head DHD, and frequency characteristics when the left ear and the right ear (microphones) of the dummy head DHD receive sound reproduced by the speaker SP30 are measured, characteristics as shown in FIG. 6, for example, are obtained. As is clear from the result of the measurement, the level of sound received by the left ear is lower than the level of sound received by the right ear, which is even true of low frequency sound that does not provide a directional feeling (especially a frequency range corresponding to the low frequency range signal SLFE).

In addition, since the converting circuit 3F in the reproducing apparatus 200 of FIG. 3 is provided so that a sound field that would be obtained by speaker reproduction can be reproduced by means of headphones, the converting circuit 3F also reproduces such decreases in the level of the low frequency range of the signals SLF and SRF for front channels.

Thus, in the reproducing apparatus 200 of FIG. 3, even when the low frequency range signal SLFE is added to the audio signals SLF to SRB for respective channels by the adding circuits 21 to 24, the level of the added low frequency range signal SLFE is lowered by the converting circuit 3F. As a result, the level of low frequency sound reaching both ears of the listener is lowered.

FIG. 7 shows a result obtained when frequency characteristics of the converting circuit 3F are measured. The result of the measurement represents frequency characteristics of output signals of the converting circuit 3F obtained when a speaker SP60 is disposed at a position 60° to the right of the front of a dummy head DHD, and the left ear and the right ear of the dummy head DHD receive sound reproduced by the speaker SP60, as shown in FIG. 5.

As is also clear from the result of the measurement, the converting circuit 3F lowers the level of low frequency ranges of the audio signals SLF and SRF. The same is true of the converting circuit 3B.

Thus, even when the low frequency range signal SLFE is added to the audio signals SLF to SRB by the adding circuits 21 to 24, the level of the added low frequency range signal SLFE is lowered by the converting circuits 3F and 3B. As a result, the level of low frequency sound reaching both ears of the listener is lowered.

SUMMARY OF THE INVENTION

In accordance with the above, the present invention is intended to prevent lack of low frequency sound to be obtained from an audio signal representing a component in a low frequency range when multichannel stereo reproduction is performed by means of headphones.

For example, an audio reproducing apparatus according to the present invention comprises a converting means for converting main audio signals included in an audio signal for a plurality of channels into audio signals that provide a reproduction sound field similar to that obtained in reproduction by means of speakers even when the audio signals are reproduced by means of headphones; and an adding means for adding an auxiliary audio signal included in the audio signal for a plurality of channels to an audio signal outputted from the converting means; wherein an audio signal outputted from the adding means is supplied to headphones.

Thus, an audio signal representing a component in a low frequency range is added to audio signals for respective channels without its level being lowered.

DETAILED DESCRIPTION OF THE INVENTION

Figure 1:
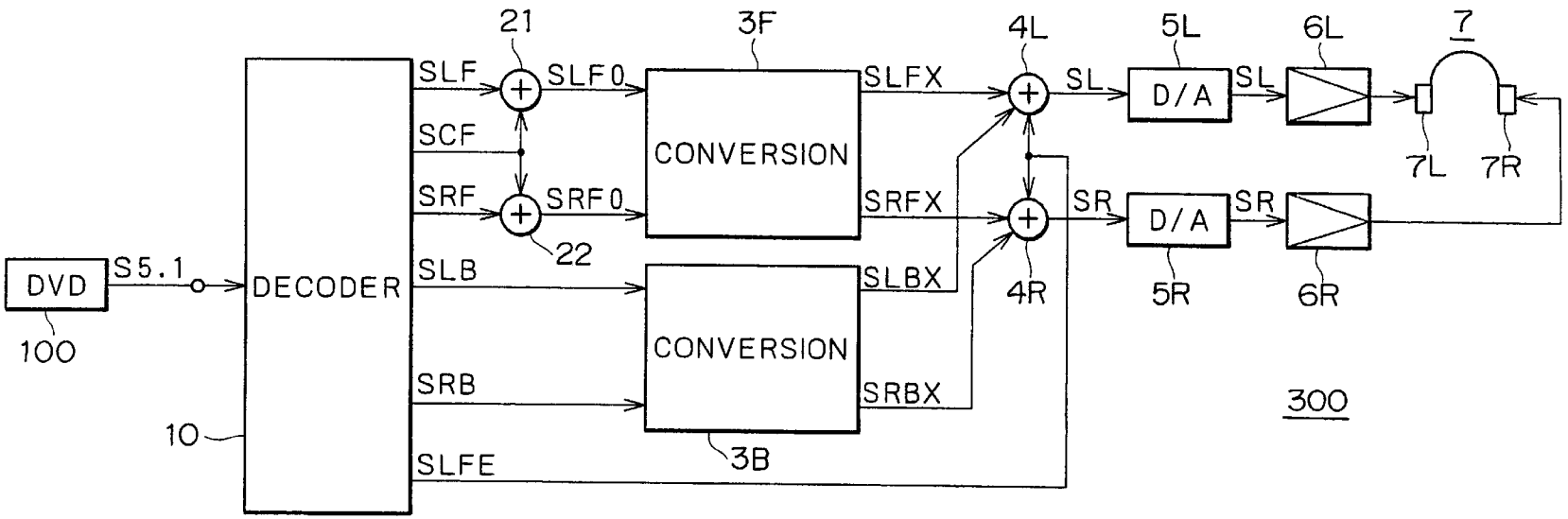
FIG. 1 is a systematic diagram showing an embodiment of the present invention.

In FIG. 1, reference numeral 300 denotes an example of an audio reproducing apparatus according to the present invention.

Now, a 5.1-channel digital audio signal S5.1 is extracted from a DVD player 100. The audio signal S5.1 is supplied to a decoder circuit 10 of an audio reproducing apparatus 300 to be decoded. Then, digital audio signals SLF to SLFE for respective channels are extracted.

The decoded and extracted audio signals SLF and SRF are thereafter supplied to a converting circuit 3F via adding circuits 21 and 22, while audio signals SLB and SRB are supplied to a converting circuit 3B as they are. Also, an audio signal SCF is supplied to the adding circuits 21 and 22 to be added to the audio signals SLF and SRF.

Figure 4:
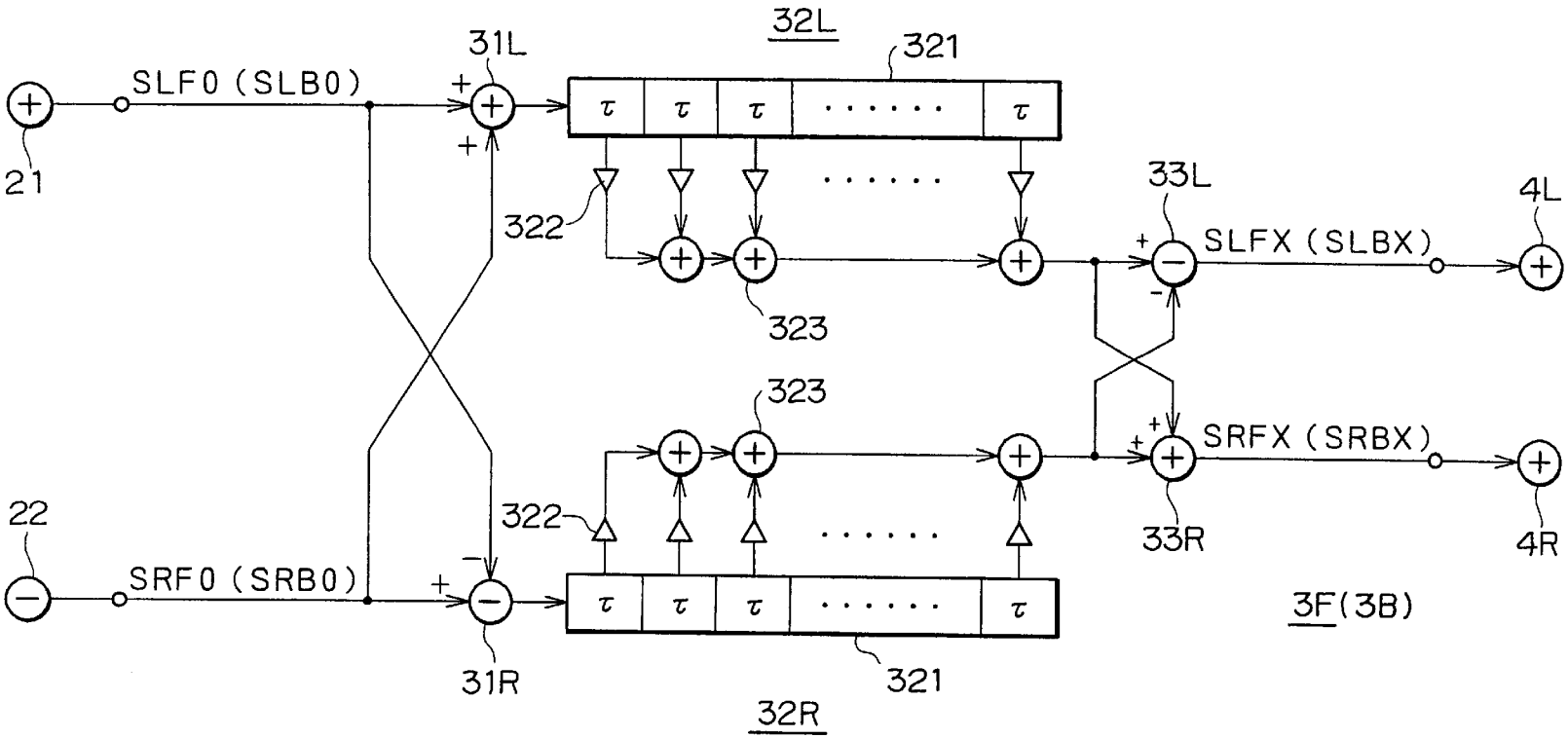
FIG. 4 is a systematic diagram showing an embodiment of a circuit that may be used with the present invention.
Figure 5:
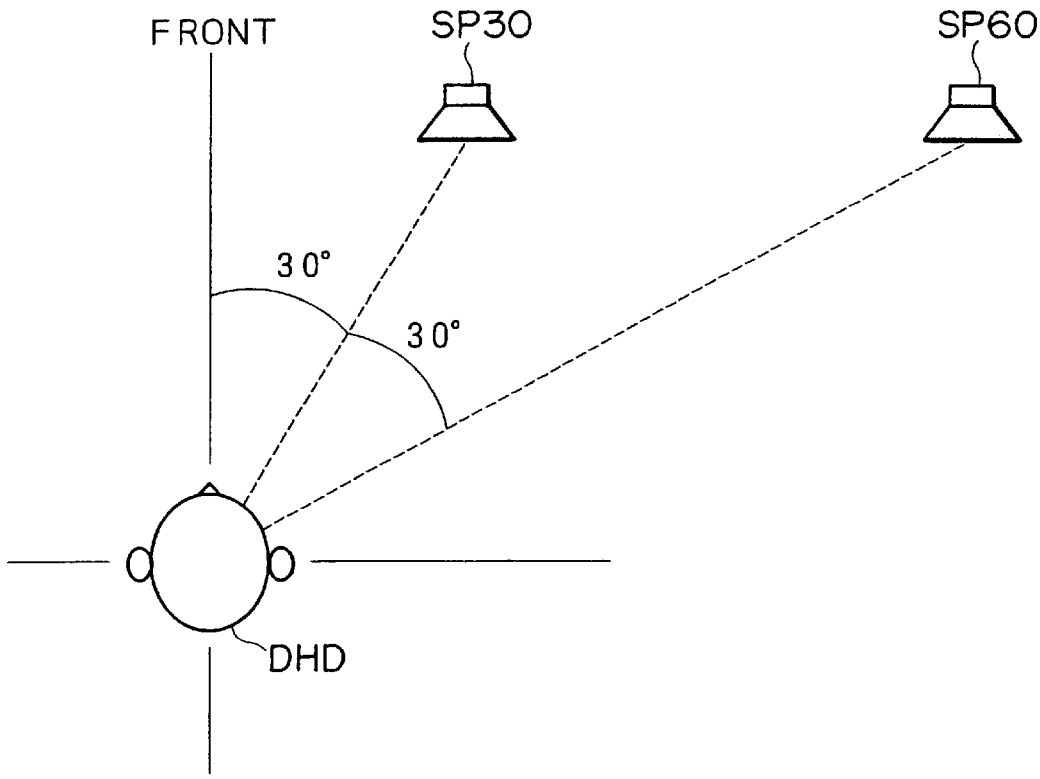
FIG. 5 is a plan view of assistance in explaining the present invention.
Figure 6:
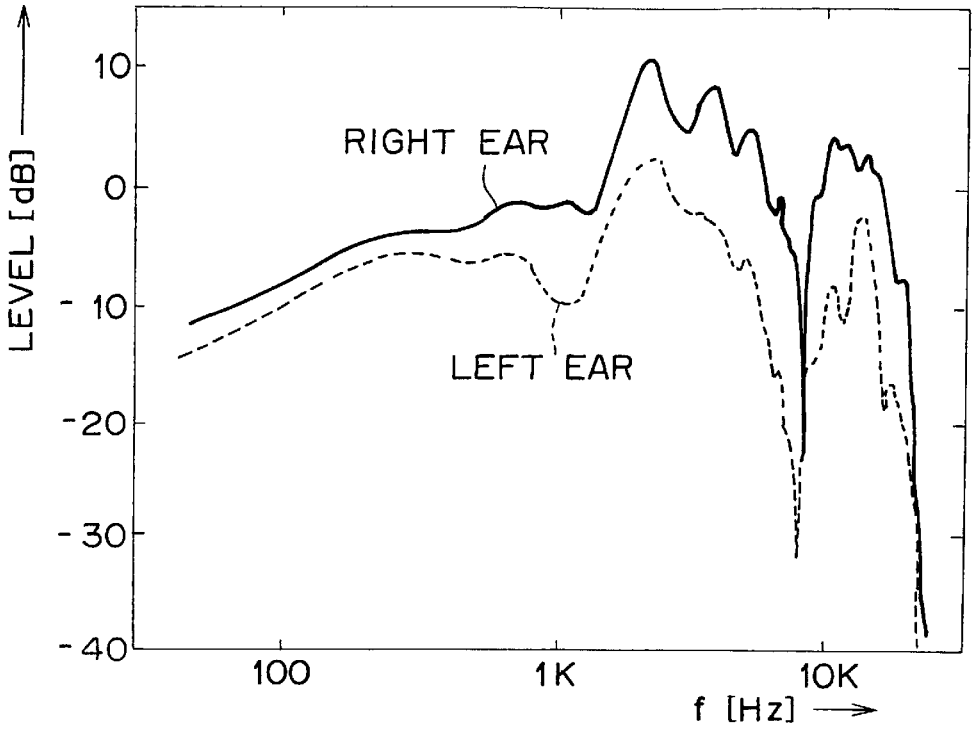
FIG. 6 is a characteristic diagram of assistance in explaining the present invention.
Figure 7:
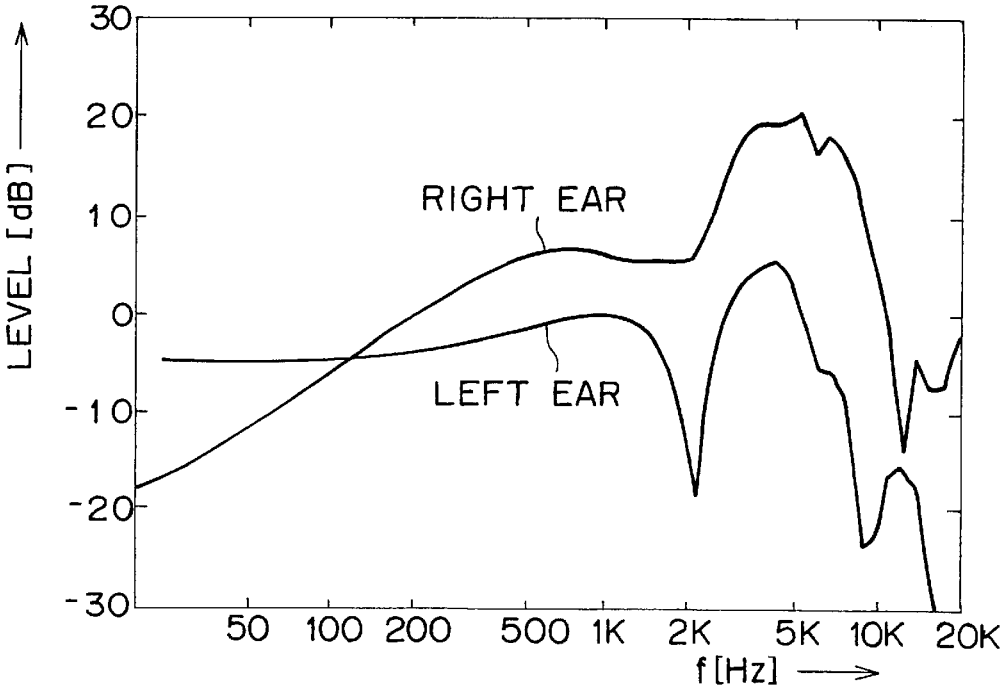
FIG. 7 is a characteristic diagram of assistance in explaining the present invention.

The converting circuits 3F and 3B are configured as described with reference to FIG. 4, for example. The audio signals SLF to SRB are converted into audio signals that provide a reproduction sound field similar to that obtained in reproduction by speakers even when the audio signals are reproduced by headphones 7.

Then, in an adding circuit 4L, an audio signal SLFX from the converting circuit 3F, an audio signal SLBX from the converting circuit 3B, and an audio signal SLFE from the decoder circuit 10 representing a component in a low frequency range are added together to be converted into a digital audio signal SL for a left channel.

Also, in an adding circuit 4R, an audio signal SRFX from the converting circuit 3F, an audio signal SRBX from the converting circuit 3B, and an audio signal SLFE from the decoder circuit 10 representing a component in a low frequency range are added together to be converted into a digital audio signal SR for a right channel.

Then, these audio signals SL and SR are supplied to D/A converter circuits 5L and 5R, where the audio signals SL and SR are subjected to D/A conversion to become analog audio signals SL and SR. The resulting audio signals SL and SR are supplied via amplifiers 6L and 6R to acoustic units 7L and 7R of the headphones 7 for a left and a right channel.

Thus, according to the audio reproducing apparatus 300, a reproduction sound field similar to that obtained by means of five speakers disposed at the left front, at the center front, at the right front, in the left rear, and in the right rear of the listener and a speaker for a low frequency range can be reproduced by means of the headphones 7.

Moreover, in this case, the audio signal SLFE representing a component in a low frequency range is added to the audio signals SLFX to SRBX without being passed through the converting circuits 3F and 3B, and therefore the level of the audio signal SLFE is not lowered by characteristics of the converting circuits 3F and 3B. Thus, it is possible to output low-frequency sound obtained from the low frequency range signal SLFE at its original level.

In addition, in order to achieve this effect, it suffices only to configure the reproducing apparatus in such a way that the low frequency range signal SLFE is supplied to the adding circuits 4L and 4R, and it is not necessary to add special characteristics to the converting circuits 3F and 3B.

Figure 2:
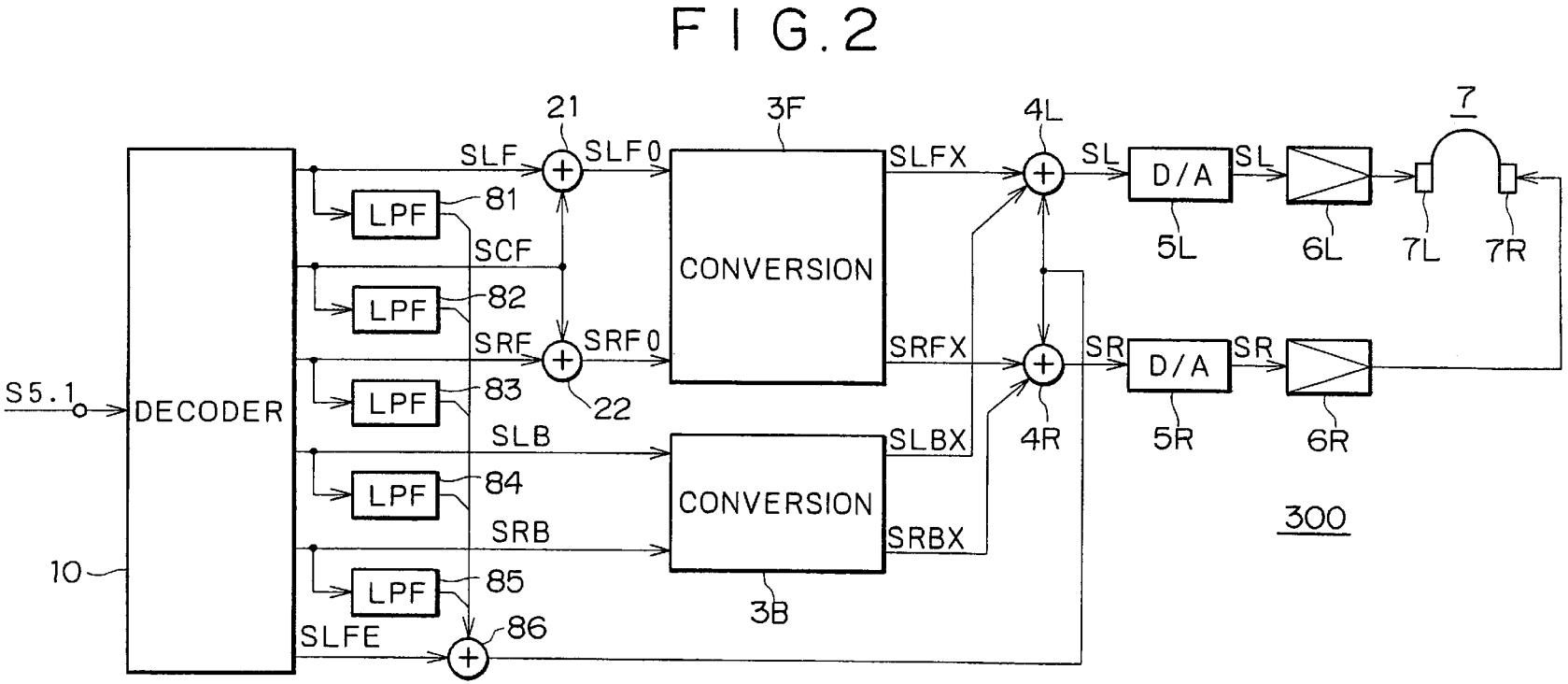
FIG. 2 is a systematic diagram showing another embodiment of the present invention.
Figure 3:
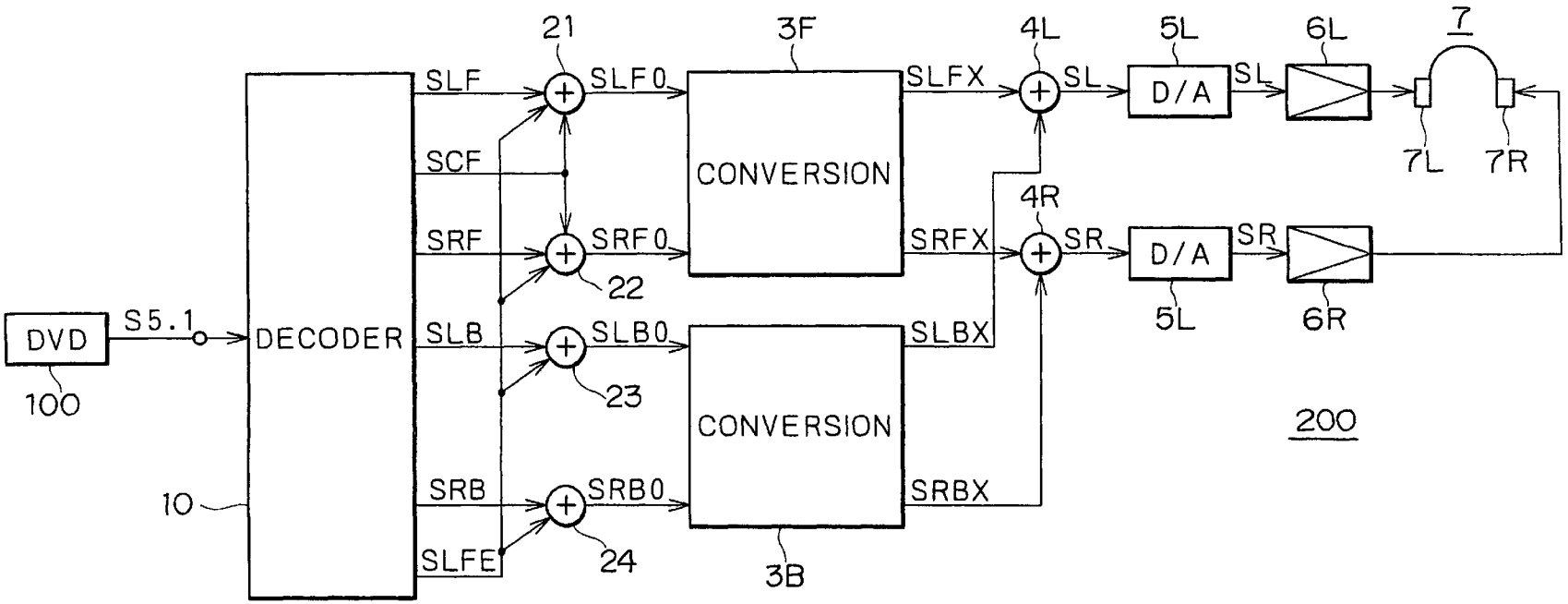
FIG. 3 is a systematic diagram of assistance in explaining the present invention.

A reproducing apparatus 300 as shown in FIG. 2 is configured in such a way that the level of components in a low frequency range included in audio signals SLF to SRB as well as an audio signal SLFE from a decoder circuit 10 will not be lowered by converting circuits 3F and 3B.

Specifically, audio signals SLF to SRB outputted from the decoder circuit 10 are supplied to circuits in the next stage, as in the reproducing apparatus 300 of FIG. 1, while a low frequency range signal SLFE outputted from the decoder circuit 10 is supplied to adding circuits 4L and 4R via an adding circuit 86.

The audio signals SLF to SRB outputted from the decoder circuit 10 are also supplied to low-pass filters 81 to 85 respectively, where audio signals representing low frequency range components in the same range as that of the low frequency range signal SLFE are extracted. The resulting signals are supplied to the adding circuit 86 and added to the low frequency range signal SLFE at a specified level or ratio.

Thus, the level of components in a low frequency range included in the audio signals SLF to SRB of a digital audio signal S5.1 is also prevented from being lowered by converting circuits 3F and 3B.

It should be noted that in the embodiment described with reference to FIG. 2, a low-pass filter is provided for each of the audio signals SLF to SRB outputted from the decoder circuit 10; however, it is also possible to configure the reproducing apparatus in such a manner that only at least one audio signal among these audio signals SLF to SRB is each provided with a low-pass filter, so that a component in a low frequency range extracted by the low-pass filter is supplied to the adding circuit 86 or the adding circuits 4L and 4R.

Moreover, in the configuration described above, it is possible to form the converting circuits 3F and 3B by using a DSP. It is also possible to include adding circuits 21, 22, 4L, and 4R in the DSP.

In addition, when a low frequency range signal SLFE from the decoder circuit 10 is supplied to the adding circuits 4L and 4R, a delay equal to the delay time occurring in the converting circuits 3F and 3B can be provided for the low frequency range signal SLFE by using a delay circuit. Furthermore, in supplying a low frequency range signal SLFE to the adding circuits 4L and 4R, if the level of the low frequency range signal SLFE is increased, for example, by providing a level adjusting circuit, a low frequency range can be boosted independently.

It is of course possible to form the delay circuit and the level adjusting circuit by using a DSP.

Moreover, connection between the reproducing apparatus 300 and the headphones 7 can be made wireless. In this case, for example, the reproducing apparatus 300 may convert audio signals SL and SR outputted from D/A converter circuits 5L and 5R into FM signals, and then transmit the FM signals by using infrared rays as carrier. The headphones 7 may obtain the FM signals by receiving the infrared rays, and demodulate the original audio signals SL and SR from the FM signals.

In addition, the above description has dealt with a case where the multichannel audio signal is a 5.1-channel digital audio signal employed in the AC-3 system; however, the present invention is applicable in cases where at least one signal of the multichannel audio signal is an audio signal representing a component in a low frequency range. The present invention is also applicable in cases where there is provided at least one sound source signal in which a component in a low frequency range is included. In this case, it is necessary to provide a low-pass filter in order to extract the component in a low frequency range from the sound source signal. Moreover, the present invention does not specifically limit the method for transmitting the single-channel or the multichannel audio signal, nor the medium for its transmission. Thus, DSB may be used, for example.

The following is a list of abbreviations used herein.

D/A: Digital to Analog

DSB: Digital Sound Broadcasting

DSP: Digital Signal Processor

DVD: Digital Versatile Disc

FM: Frequency Modulation

According to the present invention, a reproduction sound field similar to a single-channel or a multichannel stereo reproduction sound field obtained by speaker reproduction can be reproduced by means of headphones. In this case, low frequency sound obtained from an audio signal representing a component in a low frequency range or from a component in a low frequency range included in an audio signal can be outputted at its original level. Besides, it is not necessary to add a special circuit to achieve this effect.

What is claimed is:

1. An audio reproducing apparatus comprising:

converting means for converting a portion of main audio signals included in an audio signal for a plurality of channels into converted audio signals to provide a reproduction sound field substantially similar to a reproduction sound field obtained in reproduction by speakers when the converted audio signals are reproduced by headphones, wherein the main audio signals include a low-frequency auxiliary audio signal not fed to said converting means;

a plurality of low-pass filters for passing low-frequency components of the portion of the main audio signals;

first adding means for adding the low-frequency components from the plurality of low-pass filters to the auxiliary audio signal to produce an enhanced auxiliary audio signal; and second adding means for adding the enhanced auxiliary audio signal to the converted audio signals outputted from said converting means, wherein audio signals outputted from the second adding means are supplied to the headphones.

2. The audio reproducing apparatus according to claim 1, further comprising delay means for providing said enhanced auxiliary audio signal with a delay time equal to a delay time occurring between an input signal and an output signal in said converting means, whereby said enhanced auxiliary audio signal is supplied to said second adding means via the delay means.

3. The audio reproducing apparatus according to claim 1, further comprising a level adjusting means for adjusting a level of said auxiliary audio signal, whereby said auxiliary audio signal is supplied to said first adding means via the level adjusting means.

4. An audio reproducing apparatus comprising:

converting means for converting an input audio signal for at least one channel into a converted audio signal to provide a reproduction sound field substantially similar to a reproduction sound field obtained in reproduction by speakers when the converted audio signal is reproduced by headphones;

filter means for extracting a component in a low frequency range from said input audio signal for at least one channel;

first adding means for adding the component in a low-frequency range from said filter means to a low-frequency auxiliary component of the input audio signal to produce an enhanced auxiliary component; and second adding means for adding the enhanced auxiliary component to the converted audio signal outputted from said converting means;

wherein an audio signal outputted from the second adding means is supplied to headphones.

5. The audio reproducing apparatus according to claim 4, further comprising delay means for providing the component in a low frequency range extracted by said filter means with a delay time equal to a delay time occurring between an input signal and an output signal in said converting means, whereby an audio signal representing said component in a low frequency range is supplied to said first adding means via the delay means.

6. The audio reproducing apparatus according to claim 4, further comprising level adjusting means for adjusting a level of the component in a low frequency range extracted by said filter means, whereby an audio signal representing said component in a low frequency range is supplied to said first adding means via the level adjusting means.

7. An audio reproducing apparatus wherein when an input audio signal is a six-channel stereo audio signal to be supplied to first to fifth speakers disposed at the left front, at the right front, at the center front, in the left rear, and in the right rear of a listener and to a speaker for a low frequency range, in order to form a given reproduction sound field by means of sound reproduced by said first to fifth speakers and said speaker for a low frequency range, the apparatus comprising:

converting means for converting audio signals to be supplied to said first to fifth speakers, the audio signals being included in said input audio signal, into converted audio signals that provide a reproduction sound field substantially similar to a reproduction sound field obtained in reproduction by said first to fifth speakers when the converted audio signals are reproduced by headphones;

a plurality of low-pass filters for passing only low-frequency components from the audio signals to be supplied to the first to fifth speakers;

first adding means for adding the low-frequency components from the plurality of low-pass filters to the audio signal to be supplied to the speaker for a low-frequency range to produce a summed low-frequency audio signal; and second adding means for adding the summed low-frequency audio signal to said converted audio signals outputted from said converting means, wherein an audio signal outputted from the adding means is supplied to headphones.

8. The audio reproducing apparatus according to claim 7, further comprising delay means for providing the audio signal to be supplied to said speaker for a low frequency range with a delay time equal to a delay time occurring between an input signal and an output signal in said converting means, whereby the audio signal to be supplied to said speaker for a low frequency range is supplied to said first adding means via the delay means.

9. The audio reproducing apparatus according to claim 7, further comprising level adjusting means for adjusting a level of the audio signal to be supplied to said speaker for a low frequency range, whereby the audio signal to be supplied to said speaker for a low frequency range is supplied to said first adding means via the level adjusting means.

* * * * *